US006059099A

United States Patent [19]

Galbierz

[11] Patent Number: 6,059,099

[45] Date of Patent: May 9, 2000

[54] MULTI-PACK CARRIER

[75] Inventor: Michael A. Galbierz, St. Louis, Mo.

[73] Assignee: Eco-Pak Products, Inc., St. Louis, Mo.

[21] Appl. No.: 09/156,586

[22] Filed: Sep. 18, 1998

[51] Int. Cl.[7] ..... B65D 75/00

[52] U.S. Cl. ..... 206/151; 206/158

[58] Field of Search ..... 206/139, 145, 206/147, 148, 149, 151, 153, 155, 158, 159, 161, 165, 170, 174, 175, 193, 194, 197, 199, 200, 427, 429–430, 434

[56] References Cited

U.S. PATENT DOCUMENTS

| | | | |
|---|---|---|---|
| 2,654,474 | 10/1953 | Ringler . | |
| 3,038,600 | 6/1962 | Powell . | |
| 3,137,109 | 6/1964 | Rapata . | |
| 3,156,358 | 11/1964 | Randrup . | |
| 3,317,234 | 5/1967 | Burford . | |
| 3,528,697 | 9/1970 | Wood . | |
| 4,378,878 | 4/1983 | Graser . | |
| 4,378,879 | 4/1983 | Killy . | |
| 5,022,525 | 6/1991 | Schuster | 206/158 |
| 5,320,216 | 6/1994 | Pangborn | 206/158 |
| 5,323,895 | 6/1994 | Suterland et al. . | |
| 5,328,024 | 7/1994 | Sutherland . | |
| 5,445,262 | 8/1995 | Sutherland . | |
| 5,485,914 | 1/1996 | Martin . | |
| 5,487,463 | 1/1996 | Harris . | |
| 5,551,566 | 9/1996 | Sutterland | 206/427 |
| 5,573,111 | 11/1996 | Gordon et al. . | |
| 5,590,776 | 1/1997 | Galbierz . | |
| 5,639,137 | 6/1997 | Bakx | 206/158 |
| 5,816,391 | 10/1998 | Harris | 206/139 |
| 5,845,776 | 12/1998 | Galbierz et al. | 206/427 |
| 5,878,876 | 3/1999 | Galbierz et al. | 206/158 |

*Primary Examiner*—David T. Fidei
*Assistant Examiner*—J. Mohandesi
*Attorney, Agent, or Firm*—Polster, Lieder, Woodruff & Lucchesi

[57] ABSTRACT

A multi-pack carrier for holding a plurality of bottles includes a top panel, side panels depending from the top panel, and a bottom panel. The top panel has at least a top ply, a middle ply, and a bottom ply. The top ply includes a plurality of apertures with a plurality slits radiating outwardly from an edge of the each of the apertures to define a plurality of top ply tabs around the top ply apertures. The top ply apertures having a diameter less than a diameter of the bottle where the carrier intersects the bottle when a bottle is placed in the carrier so that the top ply tabs will be angled upwardly to engage the take-out bead of the bottle. The second ply has a plurality of apertures substantially coaxial with the top-ply apertures and a plurality of slits radiating outwardly from the second ply apertures defining a plurality of second ply tabs. The second ply tabs (which are shorter than the top ply tabs) are sized to engage the bottle at a point spaced from the top ply tabs, in a near-planar orientation. The third ply includes apertures substantially coaxial with the top and middle ply apertures and has a diameter slightly greater than the diameter of the take-out bead. The bottom panel has a plurality of apertures which are substantially coaxial with the apertures in the top panel. When bottles are received in the carrier, the top ply tabs engage the chime and bear the weight of the bottle. The middle ply tabs engage the bottle to maintain the bottle substantially centered with respect to the apertures in the top and bottom panels to prevent uneven loading of the top ply tabs.

In another embodiment, the bottom ply engages the underside of the bottle closure and bears the weight of the cap. The top ply tabs engage the sides of the bottle cap to help maintain the bottle's concentricity in the carrier.

28 Claims, 3 Drawing Sheets

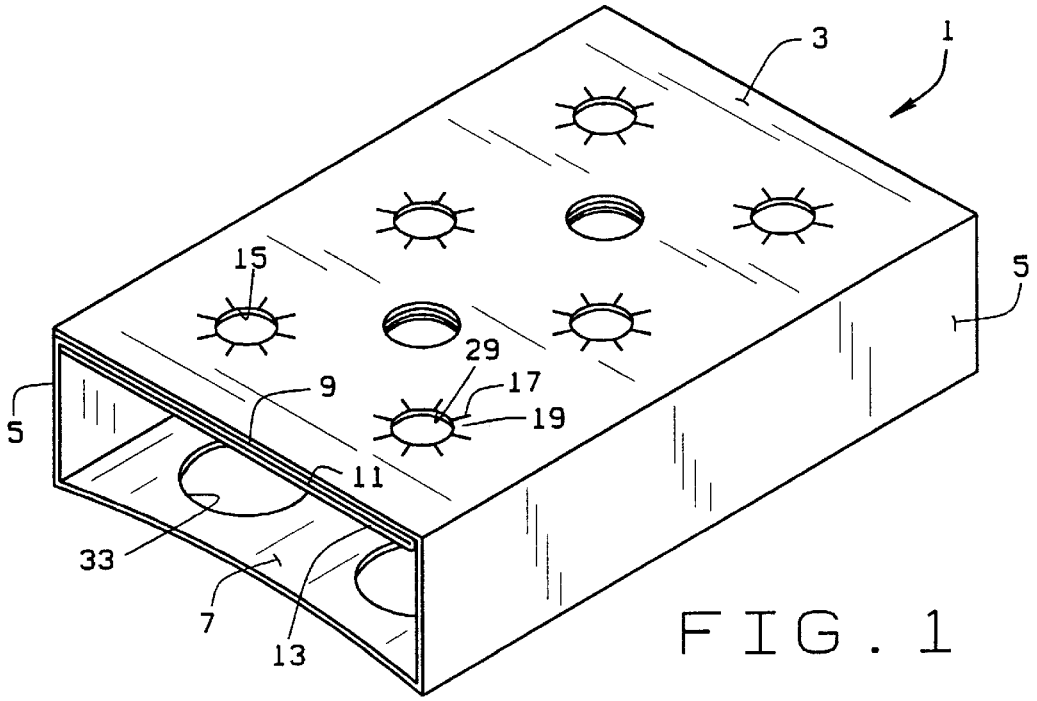
FIG. 1
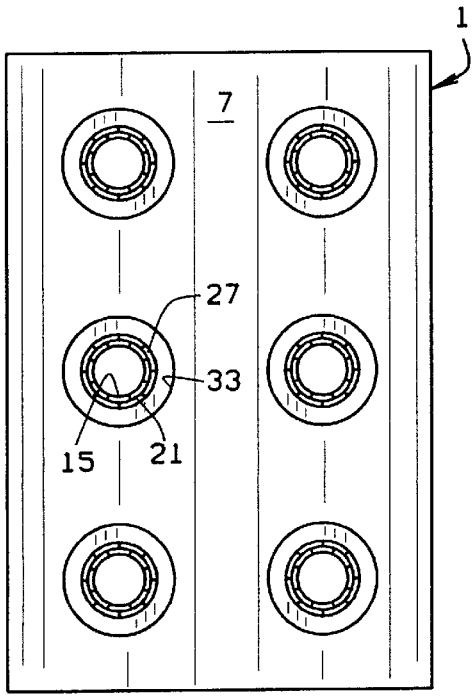
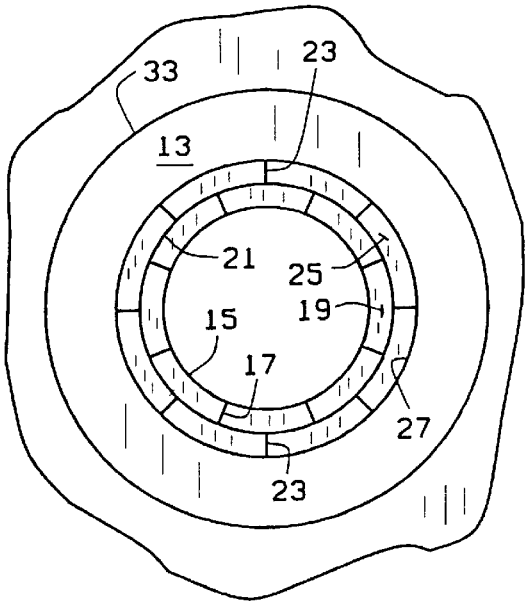
FIG. 3
FIG. 2

MULTI-PACK CARRIER

CROSS-REFERENCE TO RELATED APPLICATIONS

Not applicable

STATEMENT REGARDING FEDERALLY SPONSORED RESEARCH OR DEVELOPMENT

Not Applicable.

BACKGROUND OF THE INVENTION

This invention relates to multi-pack carriers and, in particular, to a paperboard carrier with a new tab formation which enables the carrier to carry a plurality of heavy bottles, i.e. a six-pack of one-liter glass bottles, a six-pack of two-liter PET bottles, etc., or to carry a plurality of bottles which have substantially no neck and hence no take-out bead, such as fragrance bottles, shampoo bottles, etc.

Multi-pack carriers have long been available to facilitate the carrying of bottles or the like so that customers can buy containers of beverages or other items in packages. Most of these carriers currently available are basket type carriers. Basket carriers are difficult to stack on the shelves in stores.

Flat or planar carriers and sleeve carriers overcome the manufacturing and stacking difficulties of basket carriers. Numerous types of such carriers have been developed. Examples of such carriers are shown in U.S. Pat. Nos. 5,590,776, and 5,845,776 and co-pending application Ser. No. 951,885 filed Oct. 16, 1997, now U.S. Pat. No. 5,878,876, all three of which are incorporated herein by reference. These carriers work exceedingly well for both glass and plastic bottles. However, the construction of the carriers prevents them from effectively carrying a plurality of heavy bottles. Routinely, they can carry up-to twelve pounds of product. A six pack of two-liter glass or PET bottles, on the other hand can weigh as much as, or more than, twenty-four pounds. Further, the carriers disclosed in those applications rely on a projection, lip, or cap above the shoulder of the bottle which can be engaged by the carrier's tab to hold the bottle in the carrier. However, plastic bottles such as fragrance bottles, shampoo bottles, etc. typically do not have a neck area. The cap of the bottle comes down to a point spaced only slightly above the bottle's shoulder. This small space does not provide an area which can be gripped or engaged by any carrier currently available.

Warehouse stores, such as Sams Clubs, BJ's, Cosco's, and some retail stores sell items, such as soda, water, shampoo, fragrances, etc., in bulk quantities. Such stores have created a demand for carriers which will hold a plurality of the larger (i.e., one and two-liter) glass and plastic bottles and a plurality of the fragrance or shampoo type bottles, so that they can more easily stock their shelves with bulk items.

BRIEF SUMMARY OF THE INVENTION

A multi-pack carrier is provided which can carry heavy loads, i.e., six 2-liter PET bottles. The carrier includes a top panel, opposing side panels depending from the top panel, and a bottom panel extending between the side panels to define a rectangular sleeve or box-top carrier. The top panel includes a top ply, a middle ply, and a bottom ply. The top panel top ply includes a plurality of apertures with a plurality slits radiating outwardly from their edges to define a plurality of top ply tabs. The top ply apertures have a diameter less than a diameter of the bottle where the carrier intersects the bottle when a bottle is placed in the carrier such that tabs will be angled upwardly to engage a point of engagement (i.e., chime or closure) of the bottle when a bottle is urged through the top ply aperture. The second ply includes a plurality of apertures substantially coaxial with the top-ply apertures. A plurality of slits radiate outwardly from the second ply apertures to define a plurality of second ply tabs. The second ply tabs are sized to engage the bottle at a point spaced from the top ply tabs, preferably in a near-planar orientation. The bottom ply includes a plurality of apertures positioned to be generally coaxial with the top and middle ply apertures. The third ply apertures have a diameter larger than the diameter of the bottle at the engagement point of the bottle. The bottom panel includes a plurality of apertures generally coaxial with the apertures of the top panel. The bottom panel apertures have a diameter greater than the diameter of the bottle at the point where the bottom panel intersects the bottle. However, the diameter of the bottom panel apertures less four times the thickness of the paperboard from which the carrier is made is less than the diameter of the bottle around the engagement point.

The top ply tabs engage the chime or other engagement point on the bottle and support the weight of the bottle. These are weight bearing tabs. The second ply tabs engage the bottle in generally horizontal (i.e., generally perpendicular to the bottle's axis) and serve to keep the bottle generally centered so that the bottle's axis will remain substantially coaxial with the apertures of the carrier. This will help ensure constant and equal loading of the top ply tabs to help reduce the possibility of tab failure.

In a second embodiment, the carrier can be a one-panel two ply carrier. In such a carrier, the top ply and bottom plies are identical to the top and middle plies of the three-ply top panel of the box-top carrier. A one-panel, two-ply carrier would be used with lighter bottles (i.e., ½ liter bottles).

In another embodiment, the carrier is adapted to be used with fragrance bottles, shampoo bottles, and other smaller type bottles which do not have a take out bead. Rather, these bottles have a mouth or neck extending upwardly from the bottle's shoulder, and a cap covers the mouth or neck of the bottle. The bottom of the cap, however, is spaced only slightly above the shoulders, so there is not enough room for the top ply tabs to engage the underside of the cap to support the bottle in the carrier. In this embodiment, the carrier is preferably a one panel carrier in which the panel is made of two plies. The top ply includes a plurality of apertures having a plurality slits radiating outwardly from their edges to define a plurality of top ply tabs around each top ply aperture. The top ply apertures have a diameter less than a diameter of the bottle where the carrier intersects the bottle when a bottle is placed in the carrier, and the top ply tabs are angled upwardly when a bottle is urged through the top ply aperture. The bottom ply includes a plurality of apertures which are substantially coaxial with the top ply apertures. The bottom ply apertures have a diameter approximately equal to the diameter of the bottle at the point where the carrier intersects the bottle. The second ply intersects the bottle below the cap, at a point axially spaced from the top ply tabs. Thus, the bottle cap rests on top of the second ply, making the second ply the weight bearing ply. The top ply tabs engage the side of the cap and perform a centering function. The bottom ply can include slits radiating outwardly from the bottom ply apertures. These slits are preferably microslits which are provided to ease the expansion of the bottom ply apertures as the carrier is applied to the bottles. This will help control tearing of the bottom ply. The microslits are formed in a top surface of the second or middle ply and do not extend the full thickness of the ply.

BRIEF DESCRIPTION OF THE SEVERAL VIEWS OF THE DRAWINGS

FIG. 1 is a perspective view of a carrier of the present invention;

FIG. 2 is a bottom plan view of the carrier;

FIG. 3 is an enlarged, fragmentary bottom plan view of the carrier, showing the tab arrangement of the carrier;

Corresponding reference numerals will be used throughout the drawings.

DETAILED DESCRIPTION OF THE INVENTION

The following detailed description illustrates the invention by way of example and not by way of limitation. This description will clearly enable one skilled in the art to make and use the invention, and describes what I presently believe is the best mode of carrying out the invention.

A multi-pack box-top carrier 1 of the present invention is shown in FIGS. 1–4. The carrier 1 may be made of any desired material, but is preferably made of paperboard so that the carrier may be recycled after use. The use of paperboard also enables blanks for the carrier to be easily and quickly made. Further, folding machinery for forming paperboard containers, such as box-top carriers, from blanks are well known. The carrier 1 may be made from virgin or recycled paperboard, or a combination of virgin and recycled paperboard. Preferably, the paperboard is solid unbleached sulfate virgin Kraft paperboard and should contain wet strength when the carrier will be used where moisture conditions are expected. As the need arises, a higher paperboard strength, stiffness, and rigidity can be obtained by increasing the paperboard density, by varying the paperboard formulation, by varying the machining or plying techniques used in producing the paperboard, by using paperboard made according to the Fordranier or other processes, or by using a paperboard in which the plies of the paperboard are laminated together, such that the machine direction of the plies are offset from each other by, for example, 90°. Further, the paperboard can be made from plies of different strengths. The paperboard for the carrier can also be formulated to provide a high wet strength. Brown, as-produced, paperboard can be used for the carrier. However, the paperboard is commonly made white, either by bleaching or coating the Kraft paperboard, to enable the use of quality graphics and to produce an aesthetically pleasing carrier. Other techniques can also be used to whiten brown, as-produced, paperboard. The carrier can also be made from plastic or other materials without departing from the inventive concept.

Figure 4:
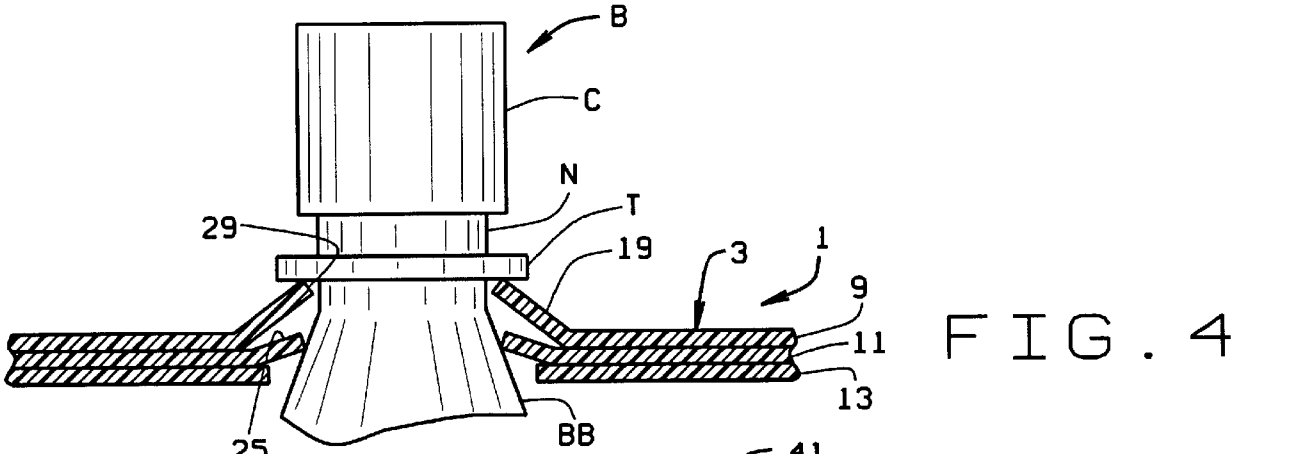
FIG. 4 is a cross-sectional view of the carrier, taken through the apertures of the carrier's top panel, with a bottle in the carrier.

Conventional bottles B, shown in FIG. 4, are received in the carrier 1. The bottles B each have a body BB, a neck N extending up from the body, a take-out bead or flange T below the mouth of the bottle, and a closure C which closes the mouth. The take-out bead T forms a chime with the neck of the bottle where the bottom of the take-out bead intersects the neck. Although the invention is described in relation to bottles, such as glass bottles, it will be understood that the invention is equally applicable to plastic bottles and bottles made of other materials, as well as to bottles of other shapes and sizes. Such other bottles may be provided with ribs or grooves and may not include take-out beads. The carrier would then engage the ribs or grooves on the bottle. Even the cap could be provided with ribs or grooves which the carrier could engage.

The carrier 1 (FIGS. 1–3) includes a top panel 3, side panels 5, and a bottom panel 7 which are interconnected to form an open-ended sleeve. Front and/or back panels may be added to close one or both ends of the carrier. The top panel 3 is made of three plies and has a top ply 9, an inner or middle ply 11, and a bottom ply 13. The bottom ply 13 is provided in part to add planar strength to the top panel 3. Thus, although three plies are preferred for carrying heavy loads, the top panel can be a two ply panel, comprising only the top and middle plies 9 and 11, if lighter loads (i.e., ½ liter bottles) are to be received in the carrier.

The top ply 9 of the carrier has a plurality of apertures 15. Preferably, the apertures 15 are evenly spaced about the top ply. In the carrier 1, six apertures are formed in the top panel in a 2×3 array. A plurality of slits 17 radiate from the edge of the apertures 15 to form tabs 19. Although scoring or embossing could be used to define the base of the tabs 19, such scoring or embossing is preferably not used. The apertures 15 have a diameter smaller than the diameter of the bottle neck N. Thus, when the bottle B is inserted in the carrier, the tabs 19 will be angled upwardly, as seen in FIG. 4, and as described below.

The middle ply 11 has a plurality of apertures 21 arranged to be generally co-axial with the top ply apertures 15. The middle ply apertures 21 have a diameter which is less than the diameter of the take-out bead or flange T and which is substantially equal to the outer diameter of the bottle at the point where the bottle is engaged by the apertures 21. A plurality of slits 23 radiate outwardly from the middle ply apertures 21 to define a second set of tabs 25. The middle ply tabs 25 are preferably shorter than the top ply tabs 19. The middle ply slits 23 and the top ply slits 17 are sized such that the circle defined by the middle ply slits is substantially equal in diameter to the circle defined by the top ply slits 17. As best seen in FIG. 3, the middle ply slits 23 are also offset from the top ply slits 17. Preferably, the middle ply slits 23 bisect the top ply tabs 19. Hence, the middle ply tabs 25 are offset from the top ply tabs 19. Preferably, the number of middle ply tabs 25 and the number of top ply tabs 19 are the same. Thus, the middle ply tabs 25 preferably also define an arc equal in degree to the arcs defined by the top ply tabs.

The off-set of the middle ply tabs 25 relative to the top ply tabs 19 increases the holding power of the carrier tabs. When the middle and top ply tabs are aligned (i.e., no off-set), a bottle can be pulled through the apertures more easily. However, when the tabs are off-set from each other, as is preferred, the tabs will reinforce each other, and it becomes more difficult to pull a bottle through the apertures. As the off-set increases, the reinforcement increases, it becomes more difficult to pull the bottle through the tabs. The maximum reinforcement occurs when the tab slits of the middle ply bisects the tabs of the top ply. The carrier 1 is shown to have eight tabs (in both the middle and upper ply). The tabs thus have a spacing of 45°. Thus, for maximum effect, the middle and upper ply tabs, of the embodiment shown in the drawings, are off-set by 22½°. This maximum off-set is preferred when heavier bottles are to be inserted in the carrier to reduce the possibility of tab failure. When lighter bottles are to be inserted in the carrier, the off-set can be changed as desired. Of course, the off-set can be made to a desired degree when designing the carrier, so that the tab reinforcement will be strong enough to hold the bottles which will be placed in the carrier, but will not be so strong as to substantially prevent a consumer from removing the bottles from the carrier.

The bottom ply 13 also has a plurality of apertures 27 which are positioned to be substantially co-axial with the top and middle ply apertures 15 and 21. The bottom ply apertures have a diameter slightly greater than the diameter of the take-out bead or flange T of the bottle B (or other engagement point), so that bottle can pass through the apertures 27 without hindrance. However, the diameter of the bottom ply apertures is not unbounded. The diameter of the bottom ply apertures is sized, so that if the top ply tabs 19 and the middle ply tabs 25 should fail and become folded or crushed, the tabs 19 and 25 would reduce the diameter of the bottom ply aperture 27 to be smaller than the diameter of the bottle's take-out bead or flange T, to prevent the bottle B from slipping through the apertures of the top panel 3. Stated differently, the diameter of the bottom panel aperture 27 is greater than the diameter of the bottle's take-out bead T. However, the bottom panel aperture diameter less four times the thickness of the paperboard from which the carrier is made is less than the diameter of the bottle's take-out bead T. Stated mathematically, if the aperture 27 has a diameter Da, the take out bead has a diameter Dt, and the paperboard has a thickness T, then:

$$Dt<Da \text{ and } Dt>Da-4T.$$

If the middle and top plies were independent from each other made from different thicknesses of paper board, then the second half of the equation would be $Dt>Da-2Tt-2Tm$, where Tt is the thickness of the top ply and Tm is the thickness of the middle ply.

The side panels 5 depend from side edges of the carrier 1. Preferably, the top and bottom panels are rectangular in plan, and have short edges and longer edges. The side panels 5 preferably depend from the longer edges 5 of the top panel 3.

The bottom panel 7 (FIG. 1) is a single piece, and has continuous uninterrupted edges which extend between the side panels. The bottom panel 7 has two rows of apertures 33 which are generally co-axial or concentric with the apertures 15, 21 and 27 in the top panel 3. Alternatively, the bottom panel apertures 33 could be offset from the respective top panel apertures, such as is shown in co-pending application Ser. No. 951,885, which is incorporated herein by reference. All that is needed is that the top panel apertures 15, 21, and 27 overlap the bottom panel apertures 33 so that there will be at least some degree of alignment between the top and bottom panel apertures (i.e., the top and bottom panel apertures should be at least partially aligned with each other). The bottom panel apertures 33 have a diameter that is substantially equal to the diameter of the bottle body BB at the plane where the bottom panel intersects the bottle body BB.

When the bottles are placed in the carrier, the bottle passes through the bottom panel aperture 33 and then through the top panel apertures. When passing though the top panel apertures, the bottle cap and take-out bead T initially pass through the bottom ply aperture 27 without hindrance. The cap C and take-out bead then pass through the middle-ply aperture 21. Because the diameter of the middle ply aperture 21 is less than the diameter of the take-out bead T, the middle ply tabs 25 will be pushed upwardly as the cap and take-out bead pass through the middle ply aperture 21. However, because the middle ply aperture 21 is sized to be substantially equal to the diameter of the bottle at the level where the top panel intersects or contacts the bottle, after the take-out bead T passes through the middle ply aperture 21, the middle ply tabs 25 will spring or fall back to a planar or near-planar orientation (i.e., an angle of 30° or less), as seen in FIG. 4, to be generally co-planar with the middle ply 11. The material from which the carrier is made has a memory. Thus, when it is turned upwardly by the cap and take-out bead of the bottle, it will not return 100% to its original position. Rather, it will have a slight upward cant as shown in the Figures. The middle ply tabs 25 engage the side of the bottle B and are placed in compression by the their engagement with the bottle B. The interaction of the middle ply tabs 25 with the bottle B will urge the bottle to the center of the middle ply aperture 21 to keep the axis of the bottle B substantially coaxial with the apertures in the bottom and top panels.

The bottle cap and the take-out bead then pass through the top ply aperture 15. As noted, the top ply aperture 15 has a diameter smaller than the diameter of bottle neck at the bottle's chime. Thus, as the bottle is passed through the top ply aperture 15, the top ply tabs 19 will be urged upwardly. After the take-out bead passes through the aperture 15, the top ply tabs will fall inwardly to engage or nest under the take-out bead, as seen in FIG. 4. If a bottle is not provided with a take-out bead, the top ply tabs 19 can engage any other engagement point, such as the bottom edge of the closure or cap C, or a flange or rib which may be provided on the bottle or its closure.

The tabs 19 are the load bearing tabs. That is, the weight of the bottle is borne by the tabs 19. The tabs 19 are of a length such that they form an angle, preferably, of about 60° with the top ply 9 when the bottle is in the carrier and the tip 29 of the tab is engaged with the bottle's take-out bead T. If the angle is much greater than 60° (i.e., more than about 75°), the tabs 19 will be too vertical and will lessen the ability of the tab 19 to engage the take-out bead T. If the angle is much less than 60° (i.e., less than about 45°), the tabs 19 will be too horizontal and will tend to collapse, not having enough vertical strength to hold the bottles B in the carrier. At present, the use of Kraft paperboard for the carrier yields sufficient strength and rigidity for the tabs 19. Preferably the tabs 19 are formed so that at least some of the tabs (tabs 19W) run with the machine direction and some of the tabs (tabs 19P) run perpendicular to the machine direction. Machine direction is shown by the arrow A in FIG. 5. This tab orientation provides for a cleaner, straight running, naturally forming breakline or base line of the tabs. Having the base lines of selected tabs run parallel and perpendicular to the machine direction, makes for a better looking and better performing tab. It also helps the flexibility of the tab and reduces delamination of the tabs when the tabs are pivoted about their base line when the carrier is applied to containers.

Figure 5:
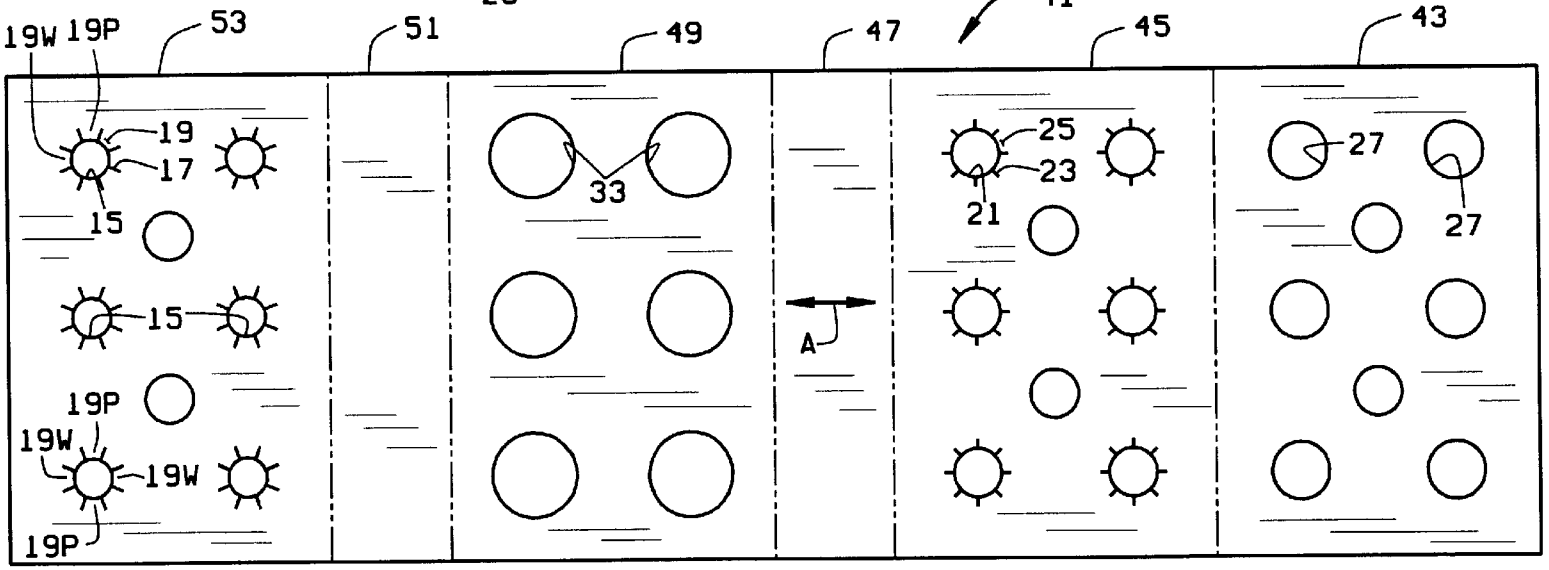
FIG. 5 is a plan view of a blank from which the carrier is formed.

When the bottle B is placed in the carrier, the middle ply tabs 25 engage the side of the bottle body or neck, as noted above. As seen in FIG. 4, when the bottle B is received in the carrier 1, the middle ply tabs 25 will generally be flat, i.e., perpendicular to axis of the bottle B. As noted above, there may be a slight upward cant in the tabs due the memory in the material from which the carrier is made. The middle ply tabs 25 are not primarily weight supporting tabs. Rather, they serve to keep the bottle axis generally coaxial with the top panel apertures 15, 21, and 27 and the bottom panel aperture 33 (FIG. 5). By keeping the bottle B substantially coaxial with the carrier apertures, the weight of the bottle B will be borne substantially equally by all the weight bearing tabs. The top ply tabs 19 are primarily weight bearing tabs. If the bottle B should shift or tilt in the carrier, then more of the weight would be borne by fewer of the tabs. This unequal loading of the tabs could lead to failure of one of the tabs 19 which bears the brunt of the weight. That tab could collapse, and then the remaining top ply tabs 19 would fail tab by tab. However, due to the diameter of the apertures of the top ply, as described above, even if the both the top ply and middle ply tabs should fail, the bottle should not slip through the top panel 3. When the tabs collapse, they will fold, bend, or crumple against the bottle, and form a wedge which will reduce the effective diameter of the bottom ply aperture 27, thereby restricting the bottle's escape from the carrier. The resulting diameter of the circle defined by the failed tabs will be less than the diameter of the take-out bead, or other engagement point of the bottle. For the bottle to slip through the carrier top panel, the bottle would have to shear through the crumpled tabs or displace the crumpled tabs and a sufficient amount of material around the bottom ply apertures 27. This shearing or displacement action requires more force than can be generated simply by the weight of the bottles. Thus, even if the carrier tabs fails, the bottles will still be retained in the carrier.

Also as noted above, the middle ply slits and the top ply slits have the same base diameter. Thus, the middle ply tabs and the top ply tabs will bend at approximately the same point. This provides support to the top ply tabs at the base of the tabs. This helps maintain the strength of the tabs by helping to maintain the position of the tabs relative to the point of engagement of the tabs 19 with the bottle. If the base of one tab were to bend, the tip 29 of the tab would fall away from the engagement point. This would lead to uneven loading of the remaining tabs, and failure of the top ply tabs 19, as discussed above. By providing a support for the base of the top ply tabs, the risk of movement of the base of the top ply tab is substantially reduced. The use of the bottom ply 11 helps rigidizes the top panels and further increases the support for the top ply tabs 19.

The number of slits 17 (FIG. 3) formed around the top ply apertures 15 depends on the diameter of the apertures to prevent the tabs from being too narrow or too wide. If the tabs are too wide, there will be insufficient contact of the tip or radially innermost edge 29 (FIG. 4) of the tab 19 with the take-out bead T and the bottle will not be adequately supported by the tabs 19 in the carrier. As noted above, the tabs are sufficiently long to form an angle of about 45° to about 75° with the carrier top panel, and preferably about 60° with the carrier top panel 5 when the tab engages the take-out bead T of the bottle. This preferred tab size (i.e., length and width) provides for a tab which will clear the diameter of the take-out bead T when the bottle is passed through the aperture, yet will allow the tab to be resilient, such that the tab will spring back to engage the take-out bead T of the bottle B.

The use of the middle ply tabs 25, which keep the bottle centered with respect to the apertures in the carrier, enable a small tab size to be used with a large or heavy bottle. If the middle ply tabs were not used, the top ply tabs may have to be made larger so that they could bear the weight of the bottle.

Preferably, there are the same number of tabs in the middle and top plies. The plies could, alternatively, have differing numbers of tabs. That is, the top ply apertures could have more or fewer tabs, as desired, than the corresponding middle ply apertures. No matter the number of tabs, the length of the top ply tabs will be longer than the middle ply tabs.

The carrier blank 41 (FIG. 5) from which carrier 1 is formed is preferably a one-piece blank made from a single piece of material. Staring from the right in FIG. 5 and moving toward the left, the blank 41 includes an end section 43 which forms the top panel third ply 13; a section 45 which forms the middle ply 11; a side section 47 which forms one of the sides 5; a further section 49 which forms the bottom panel 7; a second side section 51 which forms the other side panel 5; and an end section 53 which forms the top panel top ply 9. The blank sections are hingedly connected to each other by fold lines, embossed lines, or the like which will facilitate folding of the carrier from the blank.

The carrier blank 41 is preferably die-cut in a single step. As can be seen, the blank is linear or quadrilateral. The blanks therefore can be formed with a minimum amount of waste. The blanks 41 are folded into carriers 1 using standard folding equipment. In the folding or forming process, the sections 43 and 45 are glued, bonded, or otherwise connected together. The sections 45 and 53 are also glued, bonded, or otherwise connected together to ensure that the blank is folded into, and remains, a sleeve. Other methods could be used to secure the sections together, e.g. they could be stapled or tab locked together. The blank 41 can be folded into the carrier 1 using conventional folding equipment. Although the top panel bottom ply is preferably formed as a part of the blank 41, the bottom ply can be made a separate piece, which is secured to the underside of the middle ply 11 during a separate manufacturing step.

The carrier 1, when formed, can be flattened so that the blank can be shipped easily in bulk. At a packaging plant, the flattened carriers are easily erected to their opened form, and can be easily applied to a group of bottles to form a package.

To apply the carrier 1 to a group of bottles B, the bottles are initially grouped into an array of the appropriate number of bottles. The carrier is then taken from its flattened state and righted to form the opened sleeve. The carrier is then simply applied, either manually or by machine, over the tops of the bottles, so that the bottle caps wilt be forced through the apertures in the top panel 3 (FIG. 1), as described above. As noted above, preferably the carrier does not include a fold line, embossment, or the like to provide a demarcation of the hinged end of the tab. Thus, in applying the carrier to bottles, a press plate is used. The press plate has apertures formed in it which have a diameter generally equal to, or larger than, the diameter of the circle defined by the slots of the top and middle ply slits 17 and 23. Tine press plate is placed on top of the top panel with its apertures aligned with the top panel apertures. As the carrier is applied to the bottle, the press plate apertures will define the hinge point of the tabs. The use of the press plate will prevent the slits 17 and 23 from tearing or elongating as the bottle is urged through the top panel apertures. This will retain the integrity of the slits and will enable the top ply tabs 19 to bear weight equally.

The design of the carrier allows for the carrier to be applied to bottles individually or in groups. Further, the carrier can be applied to bottles while they are in their shipping cases. When the carriers are being applied to the bottles manually, a first carrier 1 is applied to a group of bottles of a twenty-four bottle case while the bottles are still in the case. A second carrier 1 is then applied to a second group of bottles, etc. until all the bottles are held by carriers.

When the carriers are being applied automatically (i.e., by machine rather than by hand) two, four, or more carriers can be applied simultaneously to the bottles in a case, while the bottles are in the shipping case.

Figure 6:
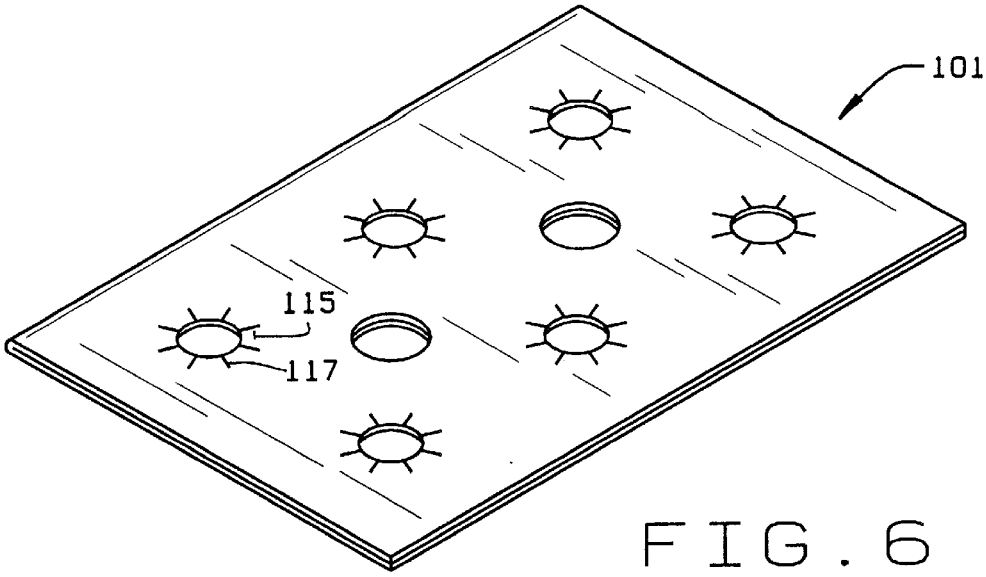
FIG. 6 is a perspective view of a second embodiment of the carrier, the carrier being a two-ply, one panel carrier.
Figure 7:
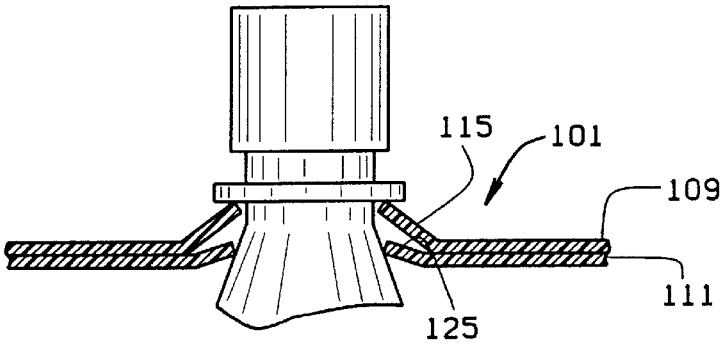
FIG. 7 is a cross-sectional view of the carrier of FIG. 6 applied to a bottle.

A single panel carrier 101 is shown in FIGS. 6 and 7. The carrier 101 is a two-ply, rather than an three-ply panel. Thus the carrier 101 includes a top ply 109 and a bottom ply 111. The top ply 109 is identical to the top ply 9 of the carrier 1 (shown in FIG. 4), and the bottom ply 111 is identical to the middle ply 11 of the carrier 1. Thus, the top ply 109 includes tabs 115 defined by slits 117, and the bottom ply 111 includes tabs 125 defined by slits. Because the carrier 101 is a two-ply single panel carrier, it is used primarily for lighter bottles or plastic bottles which can endure some pendulous motion. Although the bottles will be subject to some pendulous motion when carried in the carrier 101, the fact that the tabs 115 and 125 engage the bottle in spaced apart planes tends to reduce some of the pendulous motion.

Figure 8:
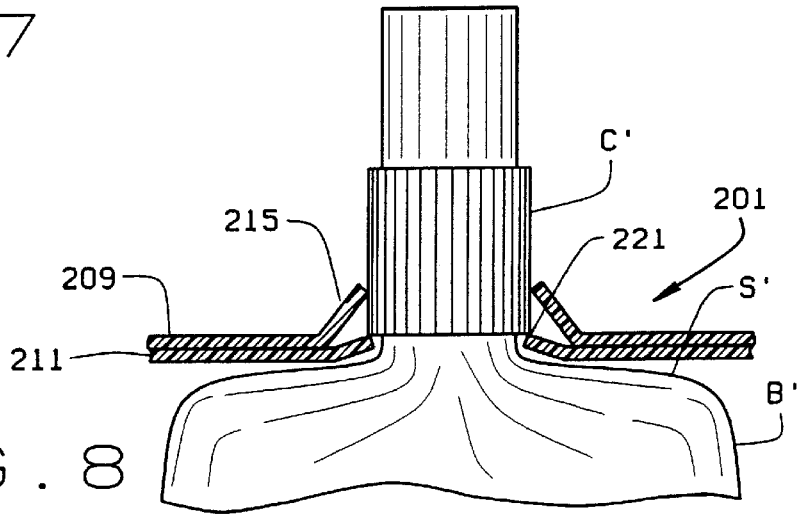
FIG. 8 is a cross-sectional view of a third embodiment of the carrier wherein the carrier is adapted to carry fragrance and shampoo type bottles which have substantially no neck.

Turning to FIG. 8, a carrier 201 is provided for use with bottles B' such as shampoo bottles, fragrance bottles, etc. These bottles are typically smaller and lighter then beverage bottles. As seen in the drawings, the bottom of the bottle cap C' is spaced only slightly above the bottle's shoulder S'. These bottles thus have substantially no exposed neck and do not have a take-out bead. The carriers 1 and 101 rely on some spacing below the cap or take-out bead of the bottle so that the weight bearing tabs will have the proper angle to engage the underside of the cap, take-out bead, etc. However, because there is virtually no space between the bottom of the cap and the shoulder, the tab cannot acquire the appropriate angle to hold the bottle. Manufactures have therefore had a difficult time designing a carrier which can hold a plurality of such bottles.

The carrier 201, like the carrier 101, is a one-panel, two-ply carrier. The carrier 201 includes a top ply 209 and a bottom ply 211. The top ply 209 is substantially identical to the top plies 9 and 109 of carriers 1 and 101, and has a plurality of top ply apertures with outwardly radiating slits to define tabs 215. The bottom ply 211 also includes a plurality of bottom ply apertures 221. The apertures 221 are generally concentric with the apertures in the top panel and have a diameter that is greater than the diameter of the top ply apertures. Where the top ply apertures have a diameter that is smaller than the diameter of the bottle cap C', the bottom ply apertures have a diameter that is generally equal to, or a slight bit smaller than, the diameter of bottle mouth just below the bottle cap C'.

The bottom ply 211 can be provided with microslits which radiate from the bottom ply apertures 221. If such microslits are provided, the slits are formed in the upper surface of the bottom ply and preferably do not extend all the way through the bottom ply 211. Alternately, slits need not be provided. Unlike the carriers 1 and 101, the bottom ply 211 of the carrier 201 is the weight bearing ply.

When the carrier is applied to the bottle, the bottle cap C' will be forced through the carrier apertures. The bottle cap will urge the bottom ply 211 upwardly to form an upwardly turned lip, as seen in FIG. 8, and will cause the top ply tabs 215 to bend at their bases. Once the cap passes through the carrier apertures, the bottom panel will engage the side of the bottle, below the cap and above the bottle shoulder S', as seen in the FIG. 8. The top ply tabs 215 engage the sides of the cap, preferably at an angle of about 60°, at a point spaced above the bottom ply 211. In this instance, the bottom edge of the cap C' rests on the bottom ply 211, and the bottom ply 211 bears the weight of the bottle. The top ply tabs 215 engage the sides of the cap and perform the centering function. This is in contrast to the carriers 1 and 101 were the top ply tabs engage the bottle to carry the weight of the bottle, and the bottom ply tabs do the centering function. When the carrier 201 is applied to the bottle, the bottom ply apertures 215 will be forced to expand. The use of microslits will alleviate some of the expansion forces to reduce the possibility of the carrier tabs ripping as it is applied to the bottle.

Like the carrier 1 and 101, the carrier 201 is preferably made from a single blank in which the apertures are formed when the blank is cut. The blank is then simply folded in half, and the two halves are adhered together to form the carrier.

In view of the above, it will be seen that the carrier of the tab arrangement can be used to support bottles of many sizes, and can even be used to support bottles having a virtually non-existent grabbing area. As various changes could be made in the above constructions without departing from the scope of the invention, it is intended that all matter contained in the above description or shown in the accompanying drawings shall be interpreted as illustrative and not in a limiting sense. For example, although the carriers are shown without release mechanisms, release mechanisms could be incorporated into the blank, and hence into the carrier, to facilitate removal of bottles from the carrier. The release mechanisms could, for example, correspond to the release mechanisms shown in U.S. Pat. No. 5,590,776 and U.S. Pat. No. 5,845,776. Other release mechanisms can also be used. The carrier 1 is shown and described for use with circular bottles. The carriers could be applied to bottles of varied shape (i.e., syrup bottles, children's drink bottles, etc.) by reshaping the bottom panel apertures. These examples are merely illustrative.

What is claimed is:

1. In combination, a multi-pack carrier and a plurality of bottles received in the carrier, the carrier and bottles defining a package, the bottles having a surface and an engagement point; the carrier comprising a panel having at least a top ply and a second ply;

the top ply including a plurality of apertures with a plurality of slits radiating outwardly from an edge of each of the apertures to define a plurality of top ply tabs surrounding each top ply aperture; the top ply tabs having a base and an inner edge opposite said base; the top ply apertures having a diameter less than a diameter of the bottle where the carrier intersects the bottle, the tabs being angled upwardly to engage the engagement point of the bottle; the first ply tabs engaging the bottle substantially at the engagement point and at a first angle when the bottle to be held in the carrier is placed in the carrier; and the second ply including a plurality of apertures substantially coaxial with the top-ply apertures and a plurality of slits radiating outwardly from the second ply apertures to define a plurality of second ply tabs around each of the second ply apertures; said second ply tabs having a base and an inner edge opposite said base and being sized such that, when the package is lifted, the substantially only the inner edges of the second ply tabs engage the bottle surface, the second ply tabs engaging the bottle surface at a point spaced from the top ply tabs and below the engagement point of the bottle; the second ply tabs engaging the bottle at a second angle; the second angle being different from the first angle such that the second ply tab is not parallel to the first ply tab.

2. The combination of claim 1 wherein the top ply tabs are longer than the bottom ply tabs.

3. The combination of claim 1 wherein the second ply tabs are centering tabs to substantially maintain said container generally axially aligned in said apertures to maintain the load on said top ply tabs substantially equal.

4. The combination of claim 1 wherein said second ply apertures have a diameter substantially equal to the diameter of the bottles where the carrier top panel intersects the bottles; whereby the second ply tabs are in a planar or near-planar orientation with respect to the second ply.

5. The combination of claim 1 wherein the number of top ply tabs around each top ply aperture is equal to the number of second ply tabs around each second ply aperture.

6. The combination of claim 1 wherein the second ply tabs are offset from the top ply tabs to a desired degree to obtain a desired amount of bottle retention from the carrier tabs.

7. The combination of claim 6 wherein the second ply slits substantially bisect the top ply tabs.

8. The combination of claim 1 wherein said panel is a top panel, said carrier including opposing side panels depending from side edges of said top panel and a bottom panel extending between said side panels; said bottom panel being spaced from said top panel; said bottom panel including a plurality of apertures; said bottom panel apertures being at least partially aligned with the apertures in the plies of the top panel; the bottom panel apertures having a diameter substantially equal to the diameter of the bottle along the plane where the carrier bottom panel intersects the bottle when the bottle is placed in the carrier.

9. The combination of claim 1 wherein said second ply slits are microslits.

10. The combination of claim 1 wherein said second ply slits are formed in a top surface of said second ply and do not extend the full thickness of the second ply.

11. The combination of claim 1 wherein the second ply tabs are generally co-planar with the carrier second ply.

12. A multi-pack carrier for holding a plurality of bottles, the bottles having an engagement point; the carrier comprising a panel including:

a top ply including a plurality of apertures with a plurality of slits radiating outwardly from an edge of each of the apertures to define a plurality of top ply tabs surrounding each top ply aperture; the top ply apertures having a diameter less than a diameter of the bottle to be held in the carrier where the carrier intersects the bottle when a bottle is placed in the carrier, the tabs being angled upwardly to engage the engagement point of the bottle to be held in the carrier when a bottle is urged through the top ply aperture;

a second ply including a plurality of apertures substantially coaxial with the top-ply apertures and a plurality of slits radiating outwardly from the second ply apertures to define a plurality of second ply tabs around each of the second ply apertures; said second ply tabs being sized to engage the bottle to be held in the carrier at a point spaced from the top ply tabs; and a third ply adjacent a bottom surface of the second ply; the third ply including a plurality of apertures positioned to be generally coaxial with the top ply and second ply apertures; the third ply apertures having a diameter larger than the diameter of engagement point bead of the bottle to be received in the carrier.

13. The carrier of claim 12 wherein the third ply apertures have a diameter less than the sum of the diameter of the bottle engagement point of the bottle to be held in the carrier, twice the thickness of the top ply, and twice the thickness of the second ply.

14. A multi-pack carrier for holding a plurality of bottles, the bottles having an engagement point which can be engaged by the carrier; the carrier comprising a top panel, opposing side panels depending from the top panel, and a bottom panel extending between said side panels;

the top panel including at least a top ply and a second ply below the top ply;

the top panel top ply including a plurality of apertures and a plurality slits radiating outwardly from an edge of the apertures to define a plurality of top ply tabs; the top ply tabs having a base and an inner edge opposite said base; the top ply apertures having a diameter less than a diameter of the bottle to be held in the carrier where the carrier intersects the bottle when a bottle is placed in the carrier, the tabs being angled upwardly to a first angle relative to the top panel when the bottle is urged through the top ply aperture to engage the bottle engagement point when the bottle is inserted in the carrier, the second ply including a plurality of apertures substantially coaxial with the top-ply apertures and a plurality of slits radiating outwardly from the second ply apertures, said slits defining a plurality of second ply tabs; the second ply tabs having a base and an inner edge opposite said base; said second ply tabs being angled at a second angle relative to the top panel when the bottle is urged through the second ply aperture, substantially only the inner edge of the second ply tabs engaging the bottle at a point spaced below the bottle engagement point; and the bottom panel including a plurality of apertures which are at least partially aligned with the top panel apertures.

15. The carrier of claim 14 wherein the bottom panel apertures have a diameter substantially equal to the diameter of the bottle to be held in the carrier at the point where the bottom panel intersects the bottle when the bottle is held in the carrier.

16. The carrier of claim 14 wherein the second ply tabs are sized to engage the bottle to be held in the carrier in a near-planar orientation when the bottle is placed in the carrier; the bottle having an axis; second ply tabs serving to maintain the bottle axis substantially coaxial with the apertures in the top and bottom panels of the carrier when the bottle is held in the carrier.

17. A multi-pack carrier for holding a plurality of bottles, the bottles having an engagement point which can be engaged by the carrier; the carrier comprising a top panel, opposing side panels depending from the top panel, and a bottom panel extending between said side panels;

the top panel including at least a top ply, a second ply below the top ply, and a third ply below the second ply;

the top panel top ply including a plurality of apertures and a plurality of slits radiating outwardly from an edge of the apertures to define a plurality of top ply tabs; the top ply apertures having a diameter less than a diameter of the bottle to be held in the carrier where the carrier intersects the bottle when a bottle is placed in the carrier, the tabs being angled upwardly to engage the engagement point of the bottle to be held in the carrier when the bottle is urged through the top ply aperture;

the second ply including a plurality of apertures substantially coaxial with the top-ply apertures and a plurality of slits radiating outwardly from the second ply apertures, said slits defining a plurality of second ply tabs; said second ply tabs being sized to engage the bottle when held in the carrier at a point spaced from the top ply tabs, said top ply tabs being longer than said second ply tabs;

the third ply including a plurality of apertures positioned to be generally coaxial with the top ply and second ply apertures; the third ply apertures having a diameter larger than the diameter of the bottle to be held in the carrier at the engagement point of the bottle;

the bottom panel including a plurality of apertures which are at least partially aligned with the top panel apertures.

18. The carrier of claim 17 wherein the third ply apertures have a diameter less than the sum of the diameter of the engagement point of the bottle to be held in the carrier, twice the thickness of the top ply, and twice the thickness of the second ply.

19. A multi-pack carrier for holding a plurality of bottles, the bottles having an engagement point; the carrier comprising a panel having:

a top ply including a plurality of apertures with a plurality slits radiating outwardly from an edge of each of the apertures to define a plurality of top ply tabs around the top ply apertures; the top ply apertures having a diameter less than a diameter of the bottle to be held in the carrier where the carrier intersects the bottle when the bottle is placed in the carrier, the tabs being angled upwardly to engage the engagement point of the bottle to be placed in the carrier when the bottle is urged through the top ply aperture;

a second ply below said top ply; said second ply including a plurality of apertures substantially coaxial with the top ply apertures and a plurality of slits radiating outwardly from the second ply apertures, said slits defining a plurality of second ply tabs; said second ply apertures having a diameter approximately equal to the diameter of the bottle to be placed in the carrier at the point where the carrier intersects the bottle when the bottle is held in the carrier; and a third ply below the second ply, the third ply including a plurality of apertures positioned to be generally coaxial with the top ply and second ply apertures; the third ply apertures having a diameter larger than the diameter of the bottle to be held in the carrier at the engagement point of the bottle.

20. The carrier of claim 19 wherein the third ply apertures have a diameter less than the sum of the diameter of the engagement point of the bottle to be held in the carrier, twice the thickness of the top ply, and twice the thickness of the second ply.

21. The carrier of claim 19 wherein the slits surrounding the top ply apertures and the second ply apertures define circles; the circle defined by the top ply slits and the circle defined by the second ply slits being substantially equal in diameter.

22. The carrier of claim 19 wherein the top ply tabs are sized to engage the bottle to be held in the carrier at an angle of between 45° and 75° when the bottle is in the carrier.

23. The carrier of claim 19 wherein the second ply tabs are sized to engage the bottle to be held in the carrier at an angle of between 0° and 30° when the bottle is in the carrier.

24. A package of bottles comprising a plurality of bottles and a multi-pack carrier which holds the bottles, the bottles including a surface and an engagement point; the carrier comprising a panel having:

a first ply including a plurality of apertures having a plurality slits radiating outwardly from an edge of each of the apertures to define a plurality of first ply tabs; the first ply tabs having a base and an inner edge opposite said base; and a second ply including a plurality of apertures substantially coaxial with the first ply apertures and a plurality of slits radiating outwardly from the second ply apertures, said slits defining a plurality of second ply tabs; said second ply tabs having a base and an inner edge opposite said base and being shorter than said first ply tabs;

whereby, the first ply tabs lie in a first plane, and the second ply tabs lie in a second plane, said first and second planes being at different angles to the panel such that one of said first and second ply tabs engage the bottle engagement point and the other of said first and second ply tabs engage the bottle at a point spaced from said engagement point; and, when the package is lifted, substantially only the inner edges of the first and second ply tabs engage the bottle.

25. The package of claim 24 wherein said second ply apertures have a diameter greater than said first ply apertures.

26. The package claim 25 wherein the slits of said first and second plies define circles, the circles defined by said first and second ply slits being substantially equal in diameter.

27. The package of claim 24 wherein said tabs of said first ply are off-set from the tabs of said second ply.

28. A carrier holding a plurality of containers, the containers each having a surface and an engagement point; the carrier having a panel comprised of at least a first ply and a second ply; said first and second plies each having a plurality of corresponding apertures through which the containers extend and a plurality of tabs surrounding each said aperture; the tabs of one of said first and second plies being weight bearing tabs which are angled upwardly to engage said container engagement point and bear generally vertical loads when the carrier with the containers is lifted; the tabs of the other of said first and second plies being centering tabs; said centering tabs engaging the container at a point spaced from said weight bearing tabs; said centering tabs bearing generally horizontal loads when the carrier with the containers is lifted to substantially maintain said container generally axially aligned in said apertures to maintain the load on said weight bearing tabs substantially equal; the weight bearing and centering tabs each having a base and an inner edge, the tabs engaging the container substantially only along the inner edge of the tabs when the carrier with the containers is lifted.

* * * * *